United States Patent [19]

Mace

[11] Patent Number: 4,730,632

[45] Date of Patent: Mar. 15, 1988

[54] CANE WITH HANDLE FEATURING GRIPPING AIDS

[75] Inventor: Ronald L. Mace, Raleigh, N.C.

[73] Assignee: Jung Corporation, Cincinnati, Ohio

[21] Appl. No.: 853,131

[22] Filed: Apr. 17, 1986

[51] Int. Cl.[4] ..... A45B 9/02; B62K 21/26

[52] U.S. Cl. ..... 135/76; 135/72; 74/551.9

[58] Field of Search ..... 135/72, 65, 76, 66, 135/74, 75, DIG. 10, DIG. 11, 68, 77, 17; 74/551.9; 403/295, 298

[56] References Cited

U.S. PATENT DOCUMENTS

| | | | |
|---|---|---|---|
| 84,457 | 11/1968 | Witzil | 135/65 |
| 187,842 | 5/1960 | Jeys | 68/228 |
| 192,068 | 1/1962 | Franklin et al. | D8/95 |
| D. 199,720 | 12/1964 | Wainerdi | 135/76 |
| 231,043 | 3/1974 | Barnett | 222/314 |
| 605,708 | 6/1898 | Fretz | 135/76 |
| 768,452 | 8/1904 | Hennessy . | |
| 1,086,310 | 2/1914 | Thrun | 30/517 |
| 1,329,915 | 2/1920 | McKensie | 135/65 |
| 1,930,501 | 10/1933 | Aronson | 431/140 |
| 2,269,029 | 1/1942 | Lounsbery | 350/98 |
| 2,409,365 | 10/1946 | Lamb | 135/72 X |
| 2,435,650 | 2/1948 | Greene | 362/32 |
| 2,618,986 | 11/1952 | Hungerford | 74/551.9 |
| 3,142,200 | 7/1964 | Stillman et al. | 74/551.9 |
| 3,157,187 | 11/1964 | Murcott | 135/68 |
| 3,177,884 | 4/1965 | Thro | 135/77 |
| 3,269,399 | 8/1966 | Smith | 135/72 |
| 3,851,980 | 12/1974 | Worth et al. | 403/172 |
| 3,883,257 | 5/1975 | Delafield | 403/172 |
| 3,966,339 | 6/1976 | Nemecek et al. | 403/292 |
| 3,995,650 | 12/1976 | Di Vito | 135/72 |
| 4,454,699 | 6/1984 | Strobl | 403/298 X |

FOREIGN PATENT DOCUMENTS

| | | | |
|---|---|---|---|
| 2067257 | 7/1981 | United Kingdom | 403/298 |

*Primary Examiner*—Robert A. Hafer
*Assistant Examiner*—D. N. Muir
*Attorney, Agent, or Firm*—Wood, Herron & Evans

[57] ABSTRACT

A cane having a one piece molded handle with a roughened area on the handle's top surface to increase gripping friction with the user's hand, upstanding shoulders at the front and rear ends of the handle that prevents the user's hand from slipping off the handle, and index finger support ribs to enhance control of the cane during use. The handle is preferably connected to a tubular shaft by a fastenerless lock that includes a stub shaft formed integral with the handle, that stub shaft having a series of lock flanges oriented generally normal to the stub shaft's axis that, prior to assembly, are of a slightly greater outside diameter than the inside diameter of the tubular shaft, so that the lock flanges are deformed upwardly in generally dish-shaped configuration when the handle's stub shaft is inserted into the tubular shaft.

6 Claims, 6 Drawing Figures

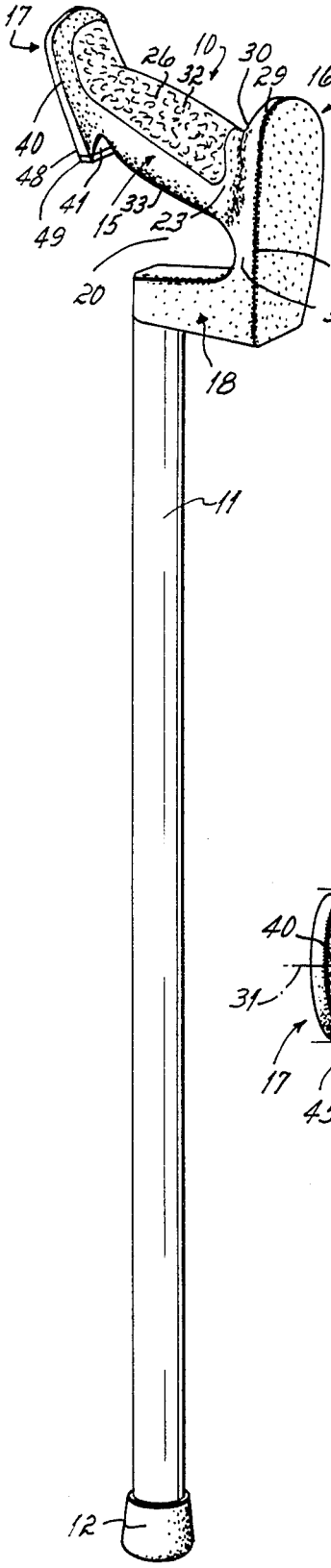
FIG. 1
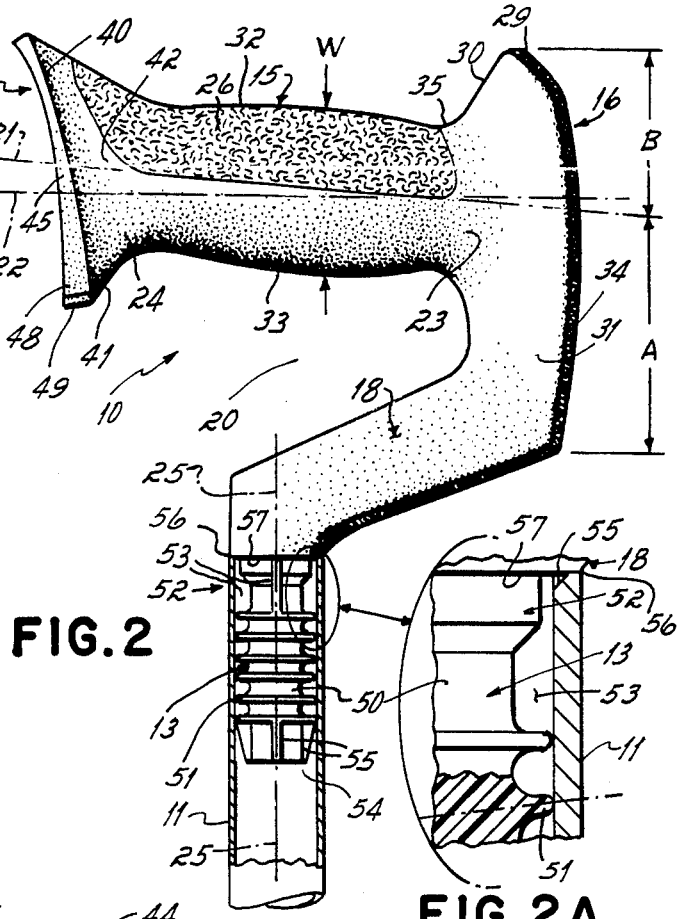
FIG. 2
FIG. 2A
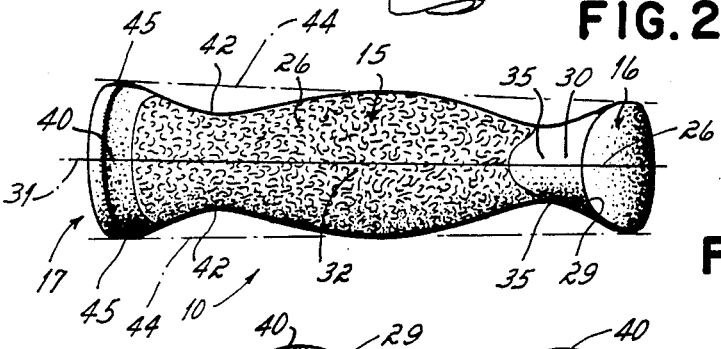
FIG. 3
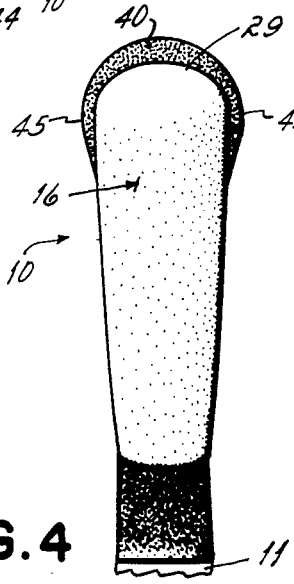
FIG. 4
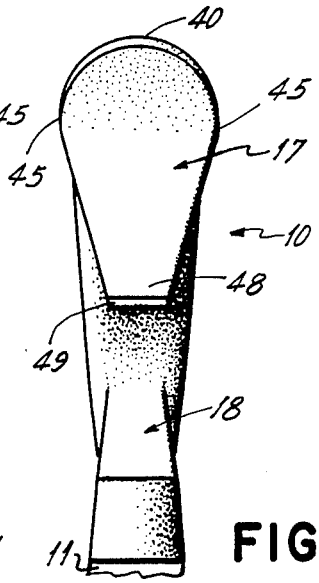
FIG. 5

CANE WITH HANDLE FEATURING GRIPPING AIDS

This invention relates to canes. More particularly, this invention relates to a cane having a novel handle structure, and a novel fastenerless lock by which the handle is connected to a tubular shaft.

Canes are, of course, very well known to the prior art. Canes are primarily used by elderly people. And the hands of the elderly are often adversely affected by age type diseases, e.g., arthritis. So it is often difficult for elderly persons with, e.g., arthritic hands, to easily grip and hold onto a cane so it can be used in the intended fashion. Since elderly people may be somewhat unstable when walking in the first place (and that, of course, is the reason they need a cane), when the cane itself is hard to grip and, thereby, hard to use, the cane does not provide the elderly user with all the stability enhancement that is desired.

It has been the primary objective of this invention to provide an improved cane that is particularly adapted for use by elderly people, and particularly by elderly people whose hands are to some extent disabled due to age or disease or both.

In accord with this objective, the cane of this invention makes use of a one piece molded handle that is connectable to a tubular shaft. The handle, in preferred form, includes a hand grip section having an axis oriented about 5° relative to a line normal to the shaft's axis, includes a stippled or roughened area on the top surface of the hand grip to increase gripping friction with the user's hand, includes upstanding shoulders at the front and back ends of the handle that prevent the user's hands from slipping off the handle, includes index finger support ribs generally vertical to the hand grip's axis on both sides of the hand grip at the handle's front end to enhance control of the cane during use, includes a high friction tip on the handle's heel to prevent the cane from slipping off a tabletop or counter when it is hung by the handle thereon, and includes a fastenerless lock by which the handle is interconnected with the cane's tubular shaft.

Other advantages and inventions of this invention will be more apparent from the following detailed description taken in connection with the drawings in which:

FIG. 1 is a perspective view illustrating a cane in accord with the principles of this invention;

FIG. 2 is a side view illustrating the cane's handle; and also illustrating the fastenerless lock by which the cane's handle is connected with the cane's shaft;

FIG. 2A is an enlarged view of the encircled portion of FIG. 2;

FIG. 3 is a top view illustrating the cane's handle;

FIG. 4 is a front end view illustrating the cane's handle; and

FIG. 5 is a rear end view illustrating the cane's handle.

The cane of this invention is illustrated in its entirety in FIG. 1. The cane basically includes a cane handle 10, a cane shaft 11, and a cane foot 12. The cane handle 10 is of a molded one piece configuration that is interconnected with the tubular shaft 11 by a novel fastenerless lock 13. The cane foot 12 is in the form of a rubber tip that is friction fit onto the bottom end of the tubular shaft 11.

The cane handle 10, as shown in the figures, includes a hand grip 15, a front end 16, a rear end 17, and a brace 18, all of a generally C-shaped configuration. The handle's hand grip 15, as shown in FIGS. 2 and 3, is of a generally elongated egg-shaped configuration 20 that has a centerline 21. When the cane shaft is oriented vertical as shown in FIG. 2, the hand grip axis 21 is angled at about 5° relative to the horizontal 22. Note that the front 23 and rear 24 ends of the hand grip are equi-distantly spaced, i.e., the grip itself is centered, relative to the shaft's axis 25. The top surface of the hand grip 15, as shown in FIG. 2, is provided with a stippled or roughened surface area 26 for the purpose of increasing frictional resistance between the user's hand and the hand grip in order to minimize slipping of the user's hand on the cane handle 10 and, thereby, enhance safety during use of the cane.

The handle 10 further includes a front end shoulder 30 and a generally vertical index finger support 31 molded integral with the front end of the hand grip 15. This front end shoulder 30 and generally vertical index finger support 31 are symmetrical relative to the hand grip's longitudinal center plane 31. The front shoulder 30 extends up above the top surface area 32 of the hand grip 15, and the index finger support 31 extends downwardly beneath the bottom surface 33 of the hand grip 15. The index finger support 31 extends downwardly from the hand grip's axis 21 a distance A about one and one-half times the width W of the hand grip, and the front shoulder 30 extends up above the hand grip's axis 21 a distance B about equal to the width of the hand grip. The front shoulder 30 includes an arcuate rib 29 along its top edge, and a saddle 35 is defined by that front shoulder's surface area that curves downwardly from the top edge 29 as viewed from the side view. The index finger support 31 includes a concave arcuate rib 34 at the outer edge. The finger support 31 is curved inwardly from the rib 34 as at 35 when viewed from the top view to provide the index finger support area, on both sides of the cane handle, thereby permitting the cane to be used by a right handed or left handed person.

A rear shoulder 40 extends upwardly about the hand grip's top surface 32 as part of the rear end 17 of the hand grip 15, and a rear heel 41 extends downwardly beneath the hand grip's bottom surface 33, also as shown in FIG. 2. This rear shoulder 40/heel 41, which is symmetrical relative to the hand grip's longitudinal plane 26, is formed with the hand grip to provide inwardly curved indentation areas or valleys 42 adjacent the rear end of the hand grip to enhance useability or gripability of the grip. As shown in FIG. 3, and with a phantom line 44 drawn that contacts the index finger rib 34, the hand grip 15, and the rear shoulder's outer edge 45, the index finger support indentations or valleys 35 are clearly shown on each side of the handle, as well as the similar indentations or valleys 42 at the rear end of the handle.

The front 30 and rear 40 shoulders at the front 16 and rear 17 ends of the hand grip 15 help to keep the user's hand from slipping off the handle during use. And the index finger support 31 on both sides of the hand grip 15 aids in the support and gripability of the handle by an elderly person, as well as in the stability of the cane when it is being used. The fact that the hand grip is of generally egg-shaped configuration when viewed from the top, as well as the side, provides a broad cross-section area in the area of the middle of the user's hand in order to accommodate arthritic hands of the elderly.

A brace 18 molded integral with the index finger support 31 at one end, and that connects with the cane shaft 11 at the other end, completes the generally C-shaped configuration of the cane handle 10. This brace 18 permits the center of the hand grip to be located approximately on the shaft's center axis 25. And this, in turn, ensures that downward pressure of the user's hand is generally directly on, i.e., co-axial with, the cane's shaft 11 when the shaft is vertical. This aids in preventing the cane from tipping or sliding during use because hand pressure is directly in line with the shaft.

The bottom end 48 of the handle's rear heel 41 is provided with a high friction tip 49, e.g., a rubber tip. This rubber tip 49 defines a generally flat area of substantial width, see FIG. 5. Note particularly, as shown in FIG. 2, that the cane's rear end can be easily hung from the top of a table or counter while the cane shaft hangs down along the front of that table or counter. The high friction tip 49 on the rear of the cane's handle tends to prevent the cane from sliding off the table or counter where it has been temporarily placed by the user.

The cane handle 10 is interconnected with the cane's tubular shaft 11 by means of a fastenerless lock 13 that, once the interconnection is made, resists turning of the handle about the shaft's axis 25, and also prevents the handle from being pulled axially back out of the shaft. This fastenerless lock 13, as shown in FIG. 2, includes a stub shaft 50 that is integral with and extends off the free end of the handle's brace 18, that stub shaft being axially alignable with the cane shaft's axis 25., The handle's stub shaft 50 includes a series of deformable lock flanges 51 normal to the cane and stub shaft's axis 25. The lock flanges 51, prior to assembly with the cane's tubular shaft 11, are each of a slightly greater outside diameter than the inside diameter of that shaft. These lock flanges 51 are spaced from the brace 18 by a non-rotation section 52 comprised of a series of four lock ribs 53 that extend-radially outward from, and parallel to, the stub shaft's axis 25. The free end section 54 of the stub shaft 50 is provided with a series of guide ribs 55 that also radially extend from, and are oriented parallel to, the stub shaft's axis 25. These guide ribs 54 taper inwardly in a generally truncated configuration.

When the cane handle 10 is to be assembled with the cane shaft 11, the guide ribs 55 on the cane handle's stub shaft 50 cooperate with the beveled inside edge 55 of the tubular shaft's top end 56 so as to properly guide the stub shaft into assembly with the cane shaft, and so as to preliminarily deform the cane shaft's top end to a limited extent so it will receive the stub shaft's lock ribs 53 (which lock ribs 53 are in line with the guide ribs 55 on the stub shaft 50). As the cane handle's stub shaft 50 is pushed or pressed into the cane shaft's open end 56, the lock flanges 51 are deformed or deflected upwardly in generally dish-shaped fashion in order to prevent the handle from being withdrawn from operational assembly with the tubular shaft 11. Further, and as the cane handle's stub shaft 50 is pushed downwardly into the shaft's open end 56 until seat 57 on the cane handle's brace 18 bottoms out against the top edge 56 of that tubular shaft 11, the lock ribs 53 are received within the tubular shaft 11, and tend to deform the circular interior of that shaft toward a cross-sectional configuration other than circular since the width of the stub shaft at the lock rib pairs is slightly greater than the inside diameter of the cane shaft. This deformation after assembly, tends to prevent rotational movement of the cane shaft 11 relative to the cane's handle 10. Accordingly, the fastenerless lock 13 incorporated on the stub shaft 50 of the cane's handle 10 cooperates with the hollow tubular top end 56 of the cane shaft 11 via the deformable friction fit rings 50 and non-deformable lock ribs 53 so that the friction fit rings resist pulling of the handle's stub shaft out from the cane shaft and so that the lock ribs resist turning of the handle's stub shaft relative to the shaft, thereby creating a permanent interconnect or lock between the two cane 10, 11 components.

Having described in detail the preferred embodiment of my invention, what I desire to claim and protect by Letters Patent is:

1. A cane comprising a cane shaft, said cane shaft having a longitudinal axis oriented vertically upright during normal use of said cane, and a one piece molded handle connected to said cane shaft, said handle having a hand grip of a generally egg-shaped configuration when viewed from the top, as well as from the side, to provide a broader cross-sectional area in the area of the middle of a user's hand in order to accommodate arthritic hands of the elderly, said hand grip having a roughened area on a top surface when said can shaft is vertically upright to increase gripping friction with the user's hand, said hand grip having an axis oriented at about 5° relative to a line noraml to said can shaft's axis, and said hand grip having opposed ends substantially equidistantly spaced on opposite sides of said cane shaft's axis, upstanding shoulders at said hand grip's opposed ends, said shoulders functioning to prevent a user's hand from slipping off said handle during use, an index finger support rib oriented generally vertical to said hand grip's axis on each side of said hand grip at one of said handle's ends to enhance control of said can during during use, said index finger supports extending downwardly from said hand grip's axis a distance about one and one-half times the width of said hand grip when said cane shaft is vertically upright, said index finger support ribs each comprising a concave arcuate rib at the outer edge of said handle's one end, each finger support being curved inwardly from said rib when viewed from a top view to provide an index finger support area on both sides of said cane handle, said shoulder and vertical index finger support ribs being substantially symmetrical relative to said hand grip's longitudinal enter plane so said handle may be. gripped equally conveniently by a user's left hand or right hand, and a brace connecting said support ribs to said can shaft so that said handle has an overall generally C-shaped configuration, said cane shaft's top end thereby being connected to one end of said hand grip and not to the middle thereof so a user's hand does not interfere with said cane shaft when the user is gripping said cane, and said brace being oriented so that the center of said hand grip is located approximately on said cane shaft's longitudinal axis so as to tend to ensure that downward pressure of a user's hand on said hand grip is generally co-axial with said cane shaft's axis when the shaft is vertically oriented.

2. A cane as set forth in claim 1, said shoulder at said one end of said handle extending up above said hand grip's axis a distance about equal to the width of said hand grip, and a heel that extends downwardly beneath said hand grip's bottom surface at said handle's other end when said cane shaft is vertically upright, said shoulder and heel at said other end being symmetrical relative to said hand grip's longitudinal plane, and being formed with said hand grip to provide inwardly curved valleys adjacent said other end of said hand grip to enhance usability of said hand grip.

3. A cane as set forth in claim 1, said cane comprising a high friction tip mounted on the bottom end of the handle's rear heel.

4. A cane as set forth in claim 1, said cane comprising a fastenerless lock by which said handle is interconnected with said shaft.

5. A can as set forth in claim 4, said cane shaft being tubular shaft, and said fastenerless lock comprising a stub shaft formed integral with said handle, said stub shaft being receivable in said tubular shaft, and a series of lock flanges oriented generally normal to said stub shaft's axis when said handle is not assembled with said tubular shaft, said lock flanges prior to assembly being of a slightly greater outside diameter than the inside diameter of said tubular shaft, said lock flanges being deformed upwardly in generally dish-shaped configuration when said handle's stub shaft is inserted into said tubular shaft in order to prevent said handle from being withdrawn from operational assembly with said tubular shaft.

6. A cane as set forth in claim 5, said fastenerless lock comprising a series of lock ribs formed integral with said handle, said lock ribs extending radially outward from, and generally parallel to, said stub shaft's axis, said lock ribs being received within said tubular shaft in a fashion that tends to deform the original inside tubular periphery of that shaft toward a cross-sectional configuration other than its original configuration, thereby tending to prevent rotational movement of said cane handle relative to said shaft after assembly.

* * * * *

UNITED STATES PATENT AND TRADEMARK OFFICE

CERTIFICATE OF CORRECTION

PATENT NO. : 4,730,632

DATED : March 15, 1988

INVENTOR(S) : Ronald L. Mace

It is certified that error appears in the above-identified patent and that said Letters Patent is hereby corrected as shown below:

Column 4, line 26 "can" should be --cane--
Column 4, line 29 "noraml" should be --normal--
Column 4, line 30 "can" should be --cane--
Column 4, line 40 "can" should be --cane--
Column 4, line 52 "enter" should be --center--
Column 4, line 56 "can" should be --cane--
Column 5, line 21 "can" should be --cane--

Signed and Sealed this

Sixth Day of June, 1989

*Attest:*

DONALD J. QUIGG

*Attesting Officer*

*Commissioner of Patents and Trademarks*